United States Patent [19]

Sheeran

[11] Patent Number: 4,933,029

[45] Date of Patent: Jun. 12, 1990

[54] WATER RESISTANT ANFO COMPOSITIONS

[76] Inventor: John P. Sheeran, 404 W. Railroad St., Middlepoint, Ohio 45863

[21] Appl. No.: 385,715

[22] Filed: Jul. 26, 1989

[51] Int. Cl.[5] ..... C06G 45/34

[52] U.S. Cl. ..... 149/7; 149/4; 149/21; 149/60; 149/61; 149/72; 149/76; 149/82; 149/83; 149/85

[58] Field of Search ..... 149/4, 7, 21, 60, 61, 149/72, 76, 82, 83, 85

[56] References Cited

U.S. PATENT DOCUMENTS 4,367,104 1/1983 Paton et al. ..... 149/7

4,384,903 5/1983 Enever ..... 149/2

*Primary Examiner*—Stephen J. Lechert, Jr.

[57] ABSTRACT

A free-flowing granular explosive comprising of an oxidizing salt, fuel, a hydrophilic thickener and a hydrophobic compound. Upon water impingement the hydrophobic compound repels water from the surface of the oxidizing salt while the hydrophilic thickener simultaneously forms a water-resistant barrier.

7 Claims, No Drawings

WATER RESISTANT ANFO COMPOSITIONS

BACKGROUND-FIELD OF INVENTION

This invention pertains to water-resistant explosives, specifically, water-resistant granular ammonium nitrate fuel oil (ANFO) compositions containing a hydrophilic thickener and a hydrophobic water-repelling additive.

BACKGROUND-DESCRIPTION OF PRIOR ART

Ammonium nitrate and fuel oil (ANFO) is the most widely used explosive in both mining and construction. Its primary advantages are that it is free-flowing, granular and very economical. Its major disadvantage is that it has no water resistance and decomposes rapidly in the presence of water. Many attempts have been made to solve this problem, and hence the development of water-bearing slurry and emulsion technologies. However, both of these arts necessarily change ANFO's natural granular free-flowing state into a cross-linked gel or emulsion paste.

Efforts have been to increase the water-resistance of ANFO and still retain its granular state. These efforts have been hampered by ammonium nitrate's unusually high solubility in water. Early attempts to insolublize the ammonium nitrate prills with various greases, resin or asphaltic coatings were not able to totally encapsulate the prills. These compositions still had to be suspended in a water-resistant paste. Other attempts to water-proof ANFO used high percentages of sensitizers, along with densifiers and temperature stabilizers. Such compositions provided to be prohibitively expensive and were never successfully commercialized. Still other methods relied heavily on high percentages of cross-linked guar gums to improve ANFO's water-resistance. In these compositions the guar gum swells to form a barrier upon impingement of water and then cross-links. But these compositions have no inherent water-repelling abilities and are extremely hydrophilic. Often large amounts of water are absorbed into the explosive before the protection barrier is established. This can result in desensitization of the explosive or loss of energy.

OBJECTS AND ADVANTAGES

Accordingly, it is the object of this invention to provide novel water-resistant compositions, which overcome the insufficiencies of the prior art.

A more specific object of this invention is to provide water-resistant explosives, which retain their free-slowing state.

Another object of invention is to provide novel compositions where costly sensitizers, densifiers and temperature stabilizers are not required for effective performance.

Another object of invention is to provide water-resistant granular explosive compositions, which exhibit good water-repelling abilities.

Further objects and advantages of this invention will become apparent after consideration of the ensuing description.

DESCRIPTION OF INVENTION

The present invention comprises coating an oxidizing salt and fuel with a hydrophylic water-swellable thichker and a hydrophobic water-repelling additive. This hydrophilic and hydrophobic additive combination allows for the development of a quicker and more effective barrier in a manner differing and much superior to the prior art.

More specifically, this invention includes the use of an oxidizing salt. The most commonly used oxidizing salts are ammonium nitrate, sodium nitrate, calcium nitrate, potassium nitrate, magnesium nitrate, ammonium perchlorate, sodium perchlorate, potassium perchlorate and magnesium perchlorate. In this invention ammonium nitrate is the preferred oxidizer in amounts from about 80–94%. Upto 50% of ammonium nitrate may be replaced with other oxidizing salts.

The fuel used in this invention is typically a hydrocarbon petroleum fuel, but other carbon and hydrogen fuels can be used, such as aromatic hydrocarbons, glycols, alcohols, fatty acids, ground coal, coke, gilsonite and other commonly used solid or liquid fuels. Due to economy and availability, #2 diesel fuel is preferred in amounts upto about 5%. Since other elements of this invention contain carbon and hydrogen, the thickeners and hydrophobic additives must be considered when determining the proper amount of fuel to use. In compositions containing high amounts of thickeners and hydrophobic additives, it may not be necessary to add any fuel.

The thickener used in this invention should be cold-water swellable and able to develop high viscosities within several minutes. Typically, one gram of thickener in 100 ml of water should be able to produce a viscosity in excess of 3,000 cps. as measured by a Brookfield viscometer using a #3 spindle. Guar gum and its deritives are able to accomplish this effectively and in an economical manner. Lower viscosity gums may be used, but higher amounts will be necessary to achieve performance equal to the higher viscosity gums. Other natural and synthetic thickeners may be used, provided they are also cold-water swellable and contribute to rapid development of viscosity. Guar gum is the preferred thickener in amounts from about $1\frac{1}{2}$–6%.

Additionally, this invention functions well with the use of any commercially available self-complexing guar gums. A selfcomplexing gum swells in water and then cross-links to form a sturdy water-resistant gel structure. Self-complexing can also be accomplished by adding 7–12% of sodium tetraborate to the guar flour. Great care must be taken that the metal crosslinking ions are not released too soon. Premature release of borate ions will cross-link the unhydrated guar particles and slow or stop development of high viscosities. This in turn will impact directly on water-resistance by allowing deeper water penetration into the explosive. The cross-linking ions should not be present in the water during the initial water-stopping phase of about 30 seconds, but only afterwards when cross-linking can take place without interference to hydration. The metal ion release rate is normally controlled by close observation of both mesh size and solubility of the cross-linker. Normally, crosslinking adds better long-term stability and protection from the leaching of oxidizing salts, much in the same way it does in slurries.

The use of a hydrophobic compound is central to this invention. Sufficient amounts of highly hydrophobic particles on ammonium nitrate prills causes water to "bead up" on the surface. Normally, ammonium nitrate prills are extremely hydrophilic and immediately absorb water and dissolve. Prills coated with a hydrophobic compound repel water at first contact, while allowing the hydrophilic thickener particles to swell and for a lasting barrier. The result in a quickly formed gel barrier, which stops water penetration in a manner differing in method and much superior to the prior art.

The water-resistance of this invention is uniquely derived by the combination usage of the cold-water swellable thickener and the hydrophobic additive. Without a thickener in the composition, water penetrates into the gaps between the hydrophobic particles and dissolves the ammonium nitrate prills in a continuing process until the entire explosive is dissolved and desensitized. On the other hand, without the use of a hydrophobic additive, no "beading" occurs on the surface of the prills and water enters the explosive much more freely despite the presence of a thickener, resulting in much deeper penetration.

Hydrophobic additives effective in this invention are compounds having less than 1% solubility in water and capable of causing water to "bead up" when applied in a thin film over a water-oxidizing salt. Compounds found to be especially effectively are fatty acids and compounds derived from then, including fatty acid salts and fatty alcohol esters. Fatty acids include palmitic, myristic, pentadecanoic, margaric, capryilic, capric, stearic, oleic and lauric, or a blend of any two or more fatty acids. Fatty acid salts include metallic stearates, oleates and palmitates, especially fatty acid salts with aluminum, zinc or an alkaline earth metal. Fatty acid salts with an alkali metal are hydrophilic and do not repel water. Fatty alcohol esters are the primary compound in natural waxes and are very effective, especially, carnauba, castor, palm and Japan wax. Additionally, petroleum paraffin, mircrocrystaline and synthetic waxes exhibit good water-repelling qualities and are effective as a hydrophobic additive. Special organics are useful, such as metallic octoates, especially aluminum octoate. The preferred hydrophobic additives are palmitic acid, stearic acid, aluminum stearate, calcium stearate, carnauba wax, petroleum wax and aluminum octoate in amounts up to about 6%.

Fillers and extenders also have some application in this invention. The extenders increase the volume of solids, which can be beneficial in auger mixing systems for ammonium nitrate. Additive extenders most compatible with this invention are insoluble in water and hydrophobic. The preferred extenders are talc, gilsonite, glass microspheres, expanded perlite, sulphur and hydrophobic bentonite in amounts upto about 5%.

The compositions of this invention are typically mixed by first coating the ammonium nitrate prills with the selected fuel. Then the thickener and the preferred hydrophobic additive are blended in, either separately or in a premix. The explosive composition is complete after a thorough mixing and is immediately ready for use.

The following tests further illustrate the superior waterresistance of compositions of this invention.

EXAMPLE #1

The first set of samples demonstrates the effect of guar gum, self-complexing guar gum and palmitic acid on water-resistance. The samples were prepared by first mixing 13 g of diesel fuel with 228 g of ammonium nitrate prills. Palmitic acid and guar gum were added in amounts indicated by table 1-A. Palmitic acid and self-complexing guar gum were added in amounts indicated by table 1-B. A self-complexing guar gum was produced by adding 10% of sodium tetraborate (30 mesh) to the guar flour. The samples were mixed thoroughly until an even coating existed over the surface of the prills. Then 125 g samples were placed in round plastic cylinders 55 mm in diameter and 100 mm high.

All samples were then tested for water-resistance by pouring 100 ml of water onto the surface of the samples within 7 seconds from a height of 40mm. After 5 minutes any water not penetrating into the sample was poured off and the sample was checked for the weight of remaining dry prills. Prills in wet sections generally dissolve in 3–15 minutes and leave only a highly viscous mass of about 30–40% water and 60–70% dissolved (desensitized) ammonium nitrate prills. Samples with larger amounts of dry prill indicate better water-resistance.

In the following tables all ingredients are expressed in percentages of total composition by weight. Results from the water-resistance test are expressed in grams of dry prills remaining from the original 125 g sample.

TABLE 1-A

| | | | | | |
|---|---|---|---|---|---|
| ANFO | 100 | 97.5 | 95 | 95 | 92.5 |
| guar | 0 | 2.5 | 2.5 | 5 | 5 |
| palmitic acid | 0 | 0 | 2.5 | 0 | 2.5 |
| remaining dry prills | 0 | 2 | 90 | 67 | 102.5 |

TABLE 1-B

| | | | | | |
|---|---|---|---|---|---|
| ANFO | 97.5 | 97.5 | 95 | 95 | 92.5 |
| complexing guar gum | 0 | 2.5 | 2.5 | 5 | 5 |
| palmitic acid | 2.5 | 0 | 2.5 | 0 | 2.5 |
| remaining dry prills | 0 | 0 | 95 | 42 | 108 |

EXAMPLE #2

The second set of samples were evaluated for water-resistance at a constant 2.5% guar gum with various amounts of aluminum stearate from 0–4.5%. Samples were prepared and tested for water-resistance in the same manner as example #1. Table 2 displays the results of the tests.

TABLE 2

| | | | | | | |
|---|---|---|---|---|---|---|
| ANFO | 97.5 | 97 | 96 | 95 | 94 | 93 |
| guar gum | 2.5 | 2.5 | 2.5 | 2.5 | 2.5 | 2.5 |
| aluminum stearate | 0 | .5 | 1.5 | 2.5 | 3.5 | 4.5 |
| remaining dry prills | 2 | 42 | 84 | 88 | 106 | 103 |

EXAMPLE #3

The third set of samples were evaluated for water-resistance at a constant 2.5% guar gum and with 2.5% of various hydrophobic additives. Samples were prepared and tested for water-resistance in the same manner as in example #1 and #2. Table 3 shows the materials used and test results

TABLE 3

| | | | | | | | | |
|---|---|---|---|---|---|---|---|---|
| ANFO | 95 | 95 | 95 | 95 | 95 | 95 | 95 | 95 |
| guar gum | 2.5 | 2.5 | 2.5 | 2.5 | 2.5 | 2.5 | 2.5 | 2.5 |
| carnauba wax | 2.5 | 0 | 0 | 0 | 0 | 0 | 0 | 0 |
| aluminum stearate | 0 | 2.5 | 0 | 0 | 0 | 0 | 0 | 0 |
| calcium stearate | 0 | 0 | 2.5 | 0 | 0 | 0 | 0 | 0 |
| aluminum | 0 | 0 | 0 | 2.5 | 0 | 0 | 0 | 0 |

TABLE 3-continued

| | | | | | | | | |
|---|---|---|---|---|---|---|---|---|
| octoate | | | | | | | | |
| petroleum wax | 0 | 0 | 0 | 0 | 2.5 | 0 | 0 | 0 |
| talc | 0 | 0 | 0 | 0 | 0 | 2.5 | 0 | 0 |
| sulphur | 0 | 0 | 0 | 0 | 0 | 0 | 2.5 | 0 |
| sodium oleate | 0 | 0 | 0 | 0 | 0 | 0 | 0 | 2.5 |
| remaining dry prills | 71 | 90 | 69 | 58 | 57 | 25 | 7 | 0 |

CONCLUSIONS, RAMIFICATIONS AND SCOPE OF INVENTION

Accordingly, the above provided examples indicate that the combination of a hydrophilic thickener and a hydrophobic compound in conjunction with oxidizing salts and fuel accomplishes a water-resistance superior to the prior art. Inversely, less materials may be used to accomplish water-resistance equal to the prior art, indicating strong economical advantages.

Thus the compositions of this invention are able to retain their free-flowing granular state, function effectively without the use of high percentages of sensitizers, densifiers, stabilizers and self-complexing guar gums, while providing a more effective and economical water-resistance for explosives.

Ramifications of the provided examples indicate various hydrophobic additives produce varying results and that other hydrophobic compounds not listed may function equivalently to preferred embodiments. Therefore, other hydrophobic compounds used to produce an effective water-resistance and which function in a manner similar to the preferred embodiments should not be excluded from the scope of this invention or used to circumvent the scope of this invention.

I claim:

1. A water-resistant granular coated explosive comprising an inorganic oxidizing salt from 80–94%, a carbonaceous fuel upto 6% and a coating of a hydrophilic cold-water swellable thickener from about 1½–6% with a hydrophobic water-repelling compound from about 0.1–6% on said salt.

2. The composition of claim 1, wherein said inorganic oxidizing salt is ammonium nitrate, with upto 50% substitutable with sodium nitrate, calcium nitrate, potassium nitrate, magnesium nitrate, ammonium perchlorate, sodium perchlorate, potassium perchlorate and magnesium perchlorate.

3. The composition of claim 1, wherein said carbonaceous fuel is #2 diesel, a petroleum hydrocarbon, aromatic hydrocarbon, glycol, alcohol, fatty acid, ground coal, coke, or gilsonite.

4. The composition of claim 1, wherein said hydrophilic thickener is guar gum.

5. The composition of claim 1, wherein said hydrophilic thickener is a self-complexing guar gum.

6. The composition of claim 1, wherein said hydrophobic waterrepelling compound is a fatty acid, fatty alcohol ester, natural wax, petroleum wax, metallic octoate, or a fatty acid salt, excluding fatty acid alkali metal salts.

7. The composition of claim 1, wherein upto about 5% of said oxidizing salt is replaced by extenders, including talc, glass microspheres, expanded perlite, sulphur and hydrophobic bentonite.

* * * * *